US005638558A

United States Patent [19]

Moore

[11] Patent Number: 5,638,558

[45] Date of Patent: Jun. 17, 1997

[54] DUAL PURPOSE PATIENT PAD WITH DIGITAL EYELETS

[76] Inventor: Florence J. Moore, P.O. Box 130121, Tyler, Tex. 75713

[21] Appl. No.: 359,433

[22] Filed: Dec. 20, 1994

[51] Int. Cl.[6] ..... A61G 7/10; A47G 9/02

[52] U.S. Cl. ..... 5/81.1; 5/625; 5/502; 5/925

[58] Field of Search ..... 5/81.1, 500, 502, 5/925, 482, 468, 625–629

[56] References Cited

U.S. PATENT DOCUMENTS

| | | | |
|---|---|---|---|
| 1,334,901 | 3/1920 | Higdon | 5/81.1 |
| 2,835,902 | 5/1958 | Fash | 5/627 |
| 3,467,974 | 9/1969 | Deutsch | 5/502 |
| 3,801,420 | 4/1974 | Anderson | 5/502 |
| 3,829,914 | 8/1974 | Treat | 5/81 R |
| 3,849,813 | 11/1974 | Neilson | 5/334 R |
| 4,067,079 | 1/1978 | Buchman | 5/81.1 |
| 4,097,943 | 7/1978 | O'Connell | 5/484 |
| 4,675,925 | 6/1987 | Littleton | 5/81.1 |
| 4,872,226 | 10/1989 | Lonardo | 5/81.1 |
| 4,909,017 | 3/1990 | Foxman | 5/484 |
| 5,010,610 | 4/1991 | Ackley | 5/502 |
| 5,155,874 | 10/1992 | Kershaw | 5/81.1 |
| 5,329,655 | 7/1994 | Garner | 5/502 |

FOREIGN PATENT DOCUMENTS

| | | | |
|---|---|---|---|
| 8704614 | 8/1987 | WIPO | 5/625 |

*Primary Examiner*—Alexander Grosz

[57] ABSTRACT

A pad is located on a bed between a human patient and the bed sheet. The pad has a slick, smooth bottom wall, such as satin. The bottom wall reduces the friction between the pad and the bed sheet, whereby the patient together with the pad can be smoothly moved on the bed or off of the bed and onto a waiting gurney. The pad has a top wall and padding interposed between the top and bottom walls, the layers joined together with channels of quilting stitches and digital eyelets which prevent caregivers accidentally dropping a patient when the patient is being moved to or from a bed/gurney, or turned, the pad is made of materials which are permeable to air and dissipate body perspiration and bodily fluids, thus promoting sanitation and can be position under the patient for indefinite periods of time to reduce the incidence of bed sores.

15 Claims, 5 Drawing Sheets

DUAL PURPOSE PATIENT PAD WITH DIGITAL EYELETS

FIELD OF THE INVENTION

The present invention relates to pads that are used for preventing bed sores on humans when laying on beds over a long period of time and for assisting caregivers in turning such humans on beds or moving such humans on and off furniture such as beds and/or gurneys.

BACKGROUND OF THE INVENTION

A. Many human beings are confined to bed for prolonged periods of time. Such confinement may be due to recovery from a medical problem or to chronic infirmity. The human patient lies on top of the pad which is on top of a bed sheet, which in turn is on top of the bed mattress.

Some of the problems that arise with bedridden patients are the prevention of bed sores that form on the skin, and the movement of the patient in the bed. These bed sores, skin ulcerations, and/or pressure sores are not only very painful to the patient, but are very expensive to treat over a period of time. Bed sores, skin ulcerations, and/or pressure sores develop in four (4) Stages, Stage 1 being a mild abrasion to the outer layer of skin, progressing to Stage 4, which is "full thickness skin loss with extensive destruction, tissue necrosis or damage to muscle, bone, or supporting structures (for example, tandon or joint capsule)." (Source: U.S. Department of Health and Human Services "Quick Reference Guide for Clinicians "Pressure Ulcers in Adults: Prediction and Prevention")

Patients frequently must be moved while laying on the bed. For example, bedridden patients must be turned every two to four hours to prevent bed sores from occurring. Furthermore, patients whose heads and upper torsos are elevated frequently slide down from the head of the bed and must be repositioned.

A preferred prior art method is to roll a draw sheet underneath the patient. The draw sheet is simply a folded bed sheet. The sides of the draw sheet are then grasped by the caregiver, lifted and pulled, thereby moving the patient to the desired position on the bed.

Hospitals and other health care institutions, typically utilize relatively coarse bed and draw sheets. The sheets are made of coarse cotton or coarse cotton/polyester thread. The sheets are seemingly chosen more for durability than for comfort. Turning or moving a bedridden patient on a draw sheet across a bed sheet is difficult because of the friction between the sheets and the weight of the patient. A health care provider who is turning or moving a patient in a bed may injure himself or herself because of the frictional drag while resisting the strain of having to grasp the edges of the draw sheet in a fist, trying not to lose control of the patient's movement. In addition, some patients are very sensitive to jerky movements as a result of recent surgery, or some other medical condition. The friction between the sheets makes smooth movement all but impossible, causing further pain to the patient and risk of injury to the caregiver. A health care provider who is turning or moving a patient in a bed may injure himself or herself because of the frictional drag and weight of the patient by using prior art means or methods. These injuries are quite common to caregivers.

As described hereinabove, prolonged confinement to a bed can cause bed sores or skin ulcerations. Bed sores are caused by pressure on the skin areas, lack of air circulation over the skin and by friction burns by objects in contact with the skin, i.e. bed sheets. Accordingly, the pad of the invention is left under the patient to facilitate the prevention of bed sores or skin ulcerations during prolonged periods of confinement in a bed. Pressure on the skin area occurs whenever a patient lies in bed. The most prominent pressure points on the body are the buttocks, shoulder blades, elbows and heels. If the weight of the body is concentrated on these particulate areas for prolonged lengths of time, the circulation of blood to these areas is decreased. Even healthy people unconsciously turn in their sleep so as to relieve this pressure.

In the prior art configuration, air is unable to circulate between the bed sheet and the skin because of the downward pressure of the body. Some hospitals and health care institutions use water or air flow mattresses to relieve pressure on the skin. However, these mattresses are covered in plastic or rubber and prevent air circulation to the skin and promote perspiration. In addition, the mattresses do not absorb perspiration, and consequently provide an environment for bacteria.

Friction burns occur whenever a patient's skin moves over a bed sheet. Depending on the type of skin of the patient, these friction burns can lead to bed sores after only two or three days of bed confinement.

As can easily be imagined, bed sores can be very painful, and add misery to a patient's confinement to a bed. Once a patient has bed sores, the number of positions that he can lay in bed is limited by the desire to avoid laying on a bed sore. Further still, because a bed sore is an open wound, it is prone to infection.

An accepted procedure for preventing bed sores involves turning the patient every two to four hours. This relieves pressure and allows air to come in contact with the part of the body that has been resting against the bed. However, when turning a patient, friction burns can occur due to movement over the bed sheet.

Besides turning a patient, a prior art method of reducing bed sores involves placing convoluted or "egg crate" foam under a patient to soften up the bed. However, the patient still lies on a bed sheet that cover the foam. The bed sheet can cause friction burns that can lead to bed sores. Also, the foam is difficult to clean and must be either disposed of or replaced if soiled with urine and faces by an incontinent patient.

The original purpose is to prevent the establishment of skin ulcerations on bedridden patients. When used on an incontinent diabetic patient who had already established a Stage 2 skin ulceration, the skin ulceration was healed within ten (10) days. It is very difficult to get any type of abrasion or sore to heal on diabetics. The unexpected results are that it accelerated the healing process by allowing more airflow to the skin, by dissipating moisture of body fluids rapidly and reducing the friction to the skin when the patient was turned and/or moved in the bed.

B. Also, some patients must be moved completely off of their beds and on to a waiting gurney or from a surgical gurney back to their bed. In emergency cases in the field away from the hospital, emergency personnel must lift the human onto a waiting gurney and then transfer the human from the gurney onto a hospital bed for treatment at the hospital facility. If the patient is an adult and is completely helpless, it is difficult to lift or move that patient off of the bed or gurney.

Hospitals, other health care institutions, and emergency services typically utilize relatively coarse bed and draw sheets and are chosen for their durability, easy maintenance, and for sanitation purposes as they can be sterilized. The sheets are made of coarse cotton or coarse cotton/polyester thread. Transferring a patient on a draw sheet is difficult because of the friction between the sheets, the weight of the patient, and no means to securely hold the draw sheet other than by grasping it in a fist, further endangers the patient and the caregiver as well. The health care provider who is moving a patient may injure himself or herself because of the frictional drag while resisting the strain of having to grasp the edges of the draw sheet in a fist, trying not to drop the patient. In addition, some patients are very sensitive to jerky movements as a result of recent surgery, injury, or some other medical condition. The friction between the sheets makes smooth movement all but impossible, causing further pain to the patient and risk of injury to the caregiver.

Other prior art methods of transferring patients off of a bed involve lifting devices such as cranes. These devices physically pick the patient up off the bed. These devices are expensive and ill-suited for moving a patient on a bed and too cumbersome to be used in the field by emergency personnel.

The original design and purpose is to provide emergency personnel and nursing personnel a means to move patients with less frictional drag. A prior art method, Treat, used longitudinal end loop handles for pulling the patient along the bed. These handles can easily slip from the caregiver's grasp or become unsewn or break from repeated use. The placement of digital eyelets within the pad lessens the possibility of the eyelets ripping loose and eliminates the possibility of emergency personnel and/or nursing personnel from accidently losing their grip, thereby dropping the patient. Also, it lessened the strain on the emergency personnel and/or nursing personnel's backs by allowing them to use different positions for leverage in lifting. Additionally, the pad can be sterilized in an autoclave, under ultraviolet light and other sterilization techniques, for use in surgical environments and for use on patients with open wounds.

SUMMARY OF THE INVENTION

It is an object of the present invention to provide a pad for use by bedridden humans, which pad assists in the turning and moving of a human in a bed and is useful in reducing the occurrence of bed sores.

Furthermore, the present invention provides a means for patient transfer on and off beds/gurneys in hospitals or health care facilities with surgical or injured patients. It may also be used in the field by emergency personnel for patient transfers.

The pad of the present invention is for use by a human lying in bed for an extended length of time. The pad reduces the incidence of bad sores on a human as well as accelerates the healing process of established bed sores by reducing pressure on the skin, providing air circulation over the skin, rapidly dissipating moisture from body fluids away from the body, and reducing friction burns with the skin. I have discovered that by using these materials which dissipate the moisture from the patient, advanced bed sores seldom occur and if the patient has established skin ulcerations, they heal much faster. The pad also assists in moving humans on the bed by reducing friction between the human and the bed. Patients lying on the pad do not receive friction burns on their skin when they are moved, as they otherwise would without this pad. Furthermore, the pad can be washed in hot water and reused many times, thus promoting hygiene. The costs are thereby reduced since the pad of the invention is not discarded and may be reused.

The pad includes a first wall, a second wall, a middle layer of padding, and four sets of four digital eyelets longitudinally on each side of the pad. The first wall is made of a smooth, slick fabric, such as nylon satin, however is not limited to nylon stain, but to other materials that are permeable to air. The first wall is adapted to be placed in contact with the sheet on the bed. The first wall fabric is slick and smooth so as to reduce friction when the first wall is slid on the bed sheet. The second wall is made of a soft, air permeable fabric such as tricote, however, is not limited to such fabric. This wall is to provide a layer which will dissipate moisture from the patient. The second wall lays substantially parallel to the first wall. The second wall is adapted to be place in contact with the human. The middle layer of padding is located between the first and second walls. The padding may be high loft hollowfill polyester, however, other fibers may be used which will also dissipate moisture and be permeable to air. The first wall, second wall and padding are coupled together. The human can lay on the pad while in bed and the pad will reduce the pressure on the human and allow air circulation through the pad and the top wall will reduce friction burns on the human so as to relieve the incidence of skin ulcerations, and the pad will assist in the movement of the human on the bed. The digital eyelets will allow one to four caregivers to place four of their fingers of each hand through each set of four eyelets, grasp the pad, and turn the patient or move the patient from bed to gurney or gurney to bed, with less effort and greatly reduced risk of accidentally dropping the patient. Other shaped holes may be used to grasp the pad, however, sets of four holes or digital eyelets are preferred.

In one aspect, the first wall is made of satin material, the second wall is made of tricote material, and the padding is made of high loft hollowfill polyester batting. Other fibers may be used which also dissipate moisture.

There is also provided a method of moving a human on a bed. A pad is placed on the bed, with the pad having a slick bottom surface and padding on top of the bottom surface. The bottom surface is located in contact with the bed sheet. The human is placed on top of the pad so as to be on the padding. The pad is slid with the human on the bed to the desired location. This slick bottom surface lessen the friction between the human and the bed sheet and eases the effort required to move the human.

DESCRIPTION OF THE PREFERRED EMBODIMENT

Figure 1:
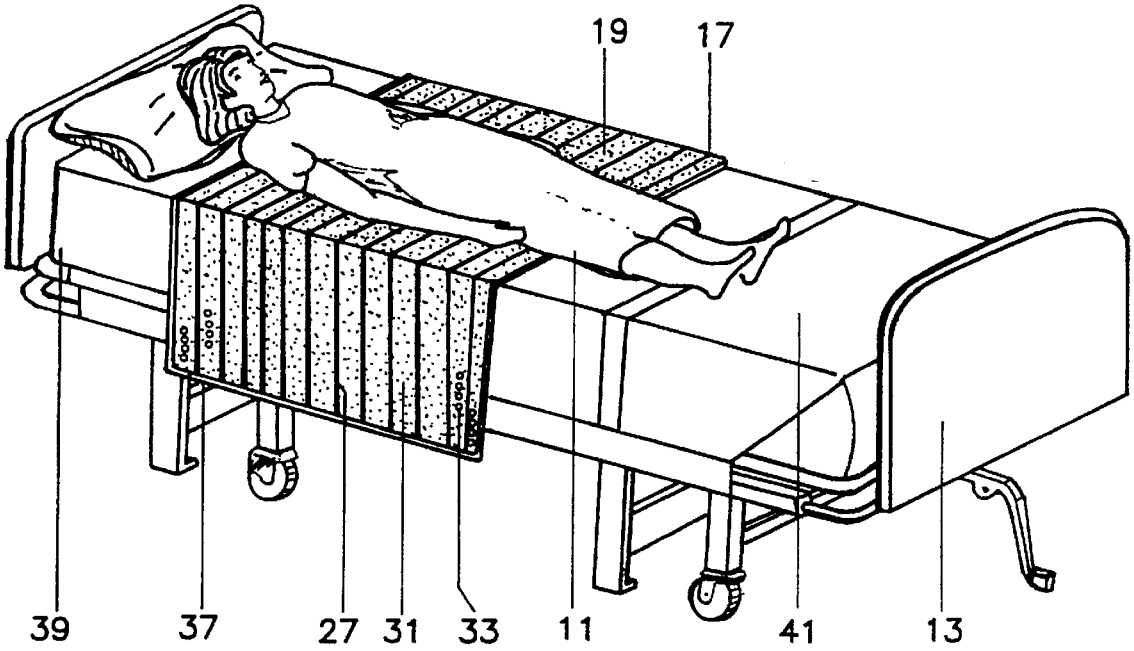
FIG. 1 is an isometric view of a human lying on a bed and on the pad of the present invention, in accordance with a preferred embodiment.

FIG. 1, there is shown a patient 11 lying in bed 13, on top of a pad 17 of the present invention, in accordance with a preferred embodiment. The pad 17 has a slick bottom surface 21, which eases the movement of the patient 11 on the bed 13 or from the bed 13 to a gurney 15. The pad 17 may be prepositioned beneath the patient 11 in anticipation of some future movement of the patient 11. The pad 17 provides a soft, comfortable pad beneath the patient 11 and reduces the risk of occurrence of bad sores.

Figure 2:
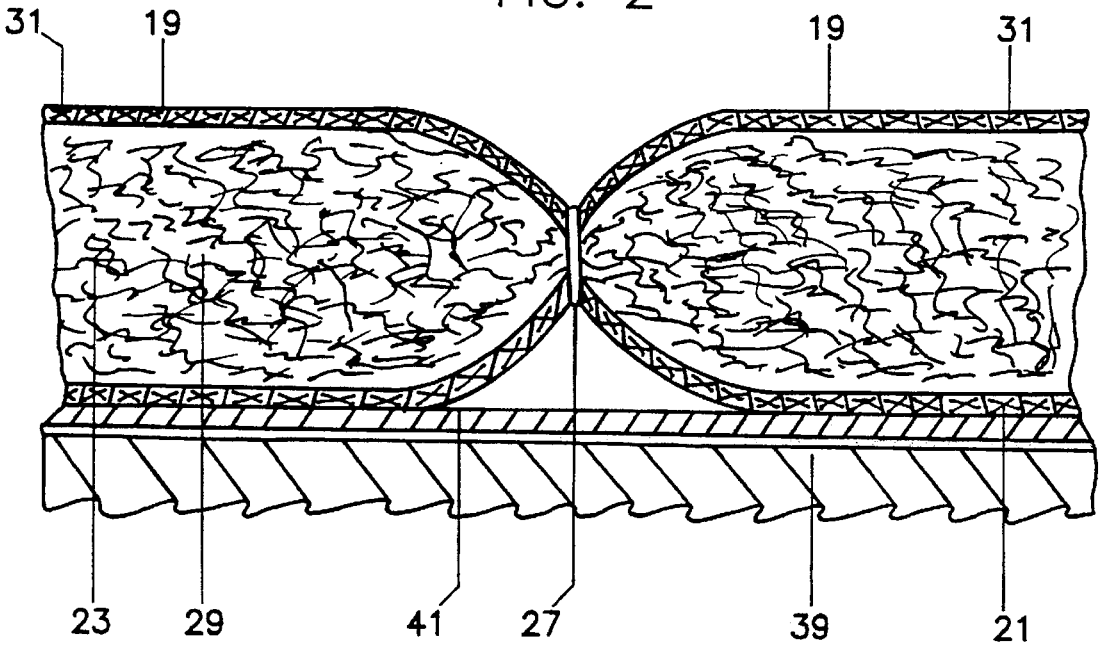
FIG. 2 is a cross-sectional view of the pad of the present invention, shown on top of a bed sheet and mattress.

As shown in FIG. 2, the pad 17 has a hollow portion 29, a top wall 19 and a bottom wall 21, and padding material 23 located therebetween.

The bottom wall 21 is made of a satin material. In the preferred embodiment, the satin material is made of slick nylon. The satin bottom wall 21 has a slick, smooth surface which is oriented so as to be on the outside of the pad 17. The bottom wall 21 is permeable to air.

The top wall 19 is also permeable to air. The top wall 19 is a soft polyester tricote material. The tricote material is an open weave, light weight material which dissipates moisture rapidly. In a preferred embodiment, the top wall 19 has plural small opening 31 located, for example, about ⅝ inches apart from each other. These openings 31 enhance the air circulation through the pad 17. The padding material 23 is polyester high loft hollowfill batting that is permeable to air. The batting 23 is 10 ounce weight of hollowfill polyester, which has a high loft. The batting 23 is 2½ to 3½ inches thick in the preferred embodiment. The polyester hollowfill high loft batting 23 allows for air circulation through the pad 17 and allows for air circulating through the pad 17 and allows for the evaporation of moisture.

The polyester hollowfill high loft batting 23 is interposed between the top and bottom walls 19, 21. The top and bottom walls 19, 21 are substantially parallel to each other. The top and bottom walls 19, 21 and the batting 23 are sewn together with thread to form quality indentations 27 quilting stitches along the sides and through the center of the pad in a quilting manner. The quilting stitches 27 extend lengthwise from end 31 to and and are spaced about three inches apart. The quilting stitches 27 hold the batting 23 in place so that the batting 23 will not lump during washing and so that the polyester high loft hollowfill batting 23 will stay fluffed to allow air circulation therethrough. The pad 17 is left under the patient 11 for the prevention of skin ulcerations and/or treatment of established skin ulcerations.

Figure 5:
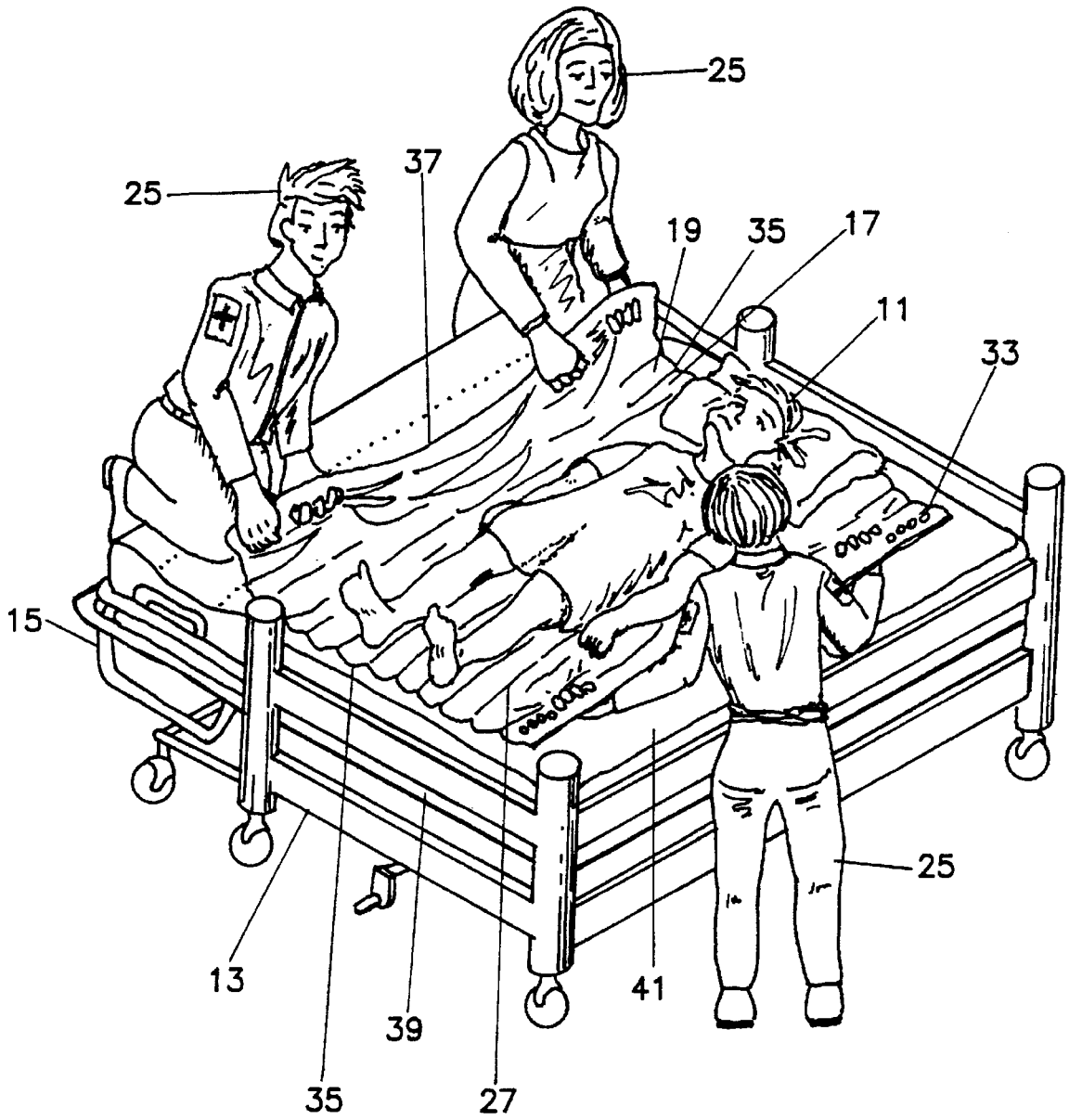
FIG. 5 is a view of several caregivers moving a human from bed to gurney by use of the pad of the invention.

There are one or two sets of four, ¾ inch inside diameter, reenforced digital eyelets 33 at each corner of the pad 17, beginning 3 inches from the outside edges 35 and 37, spaced ¼ inch apart. A second set of four, ¾ inch inside diameter, reenforced digital eyelets 33 are placed ¼ inch apart, 9 inches from each end 35 and 5 inches from the outside edges 37. The purpose of the eyelets 33 is that the caregiver 25 may place four fingers in each set of eyelets 33 in order to give them better leverage and grip to turn the patient 11 in bed 13, thereby reducing risk of injury to the caregiver 25. When the pad 17 is being used to transfer the patient 11 from bed 13 to gurney 15 or gurney 15 to bed 13 as shown in FIG. 5, either two caregivers 25 may lift and transfer the patient 11 by each placing four fingers in one set of eyelets 33 at each end of the pad 17, or up to four caregivers 25 will each have two sets of eyelets 33 in the event the patient 11 is large or very heavy. The reenforced digital eyelets 33 set inside the pad 17 all but eliminate the possibility of the caregivers 25 accidentally dropping the patient 11 without warning. As with previous devices such as Treat, U.S. Pat. No. 3,829,914, attached handles can suddenly tear loose due to worn thread or handles themselves can break from repeated use or age.

Figure 3:
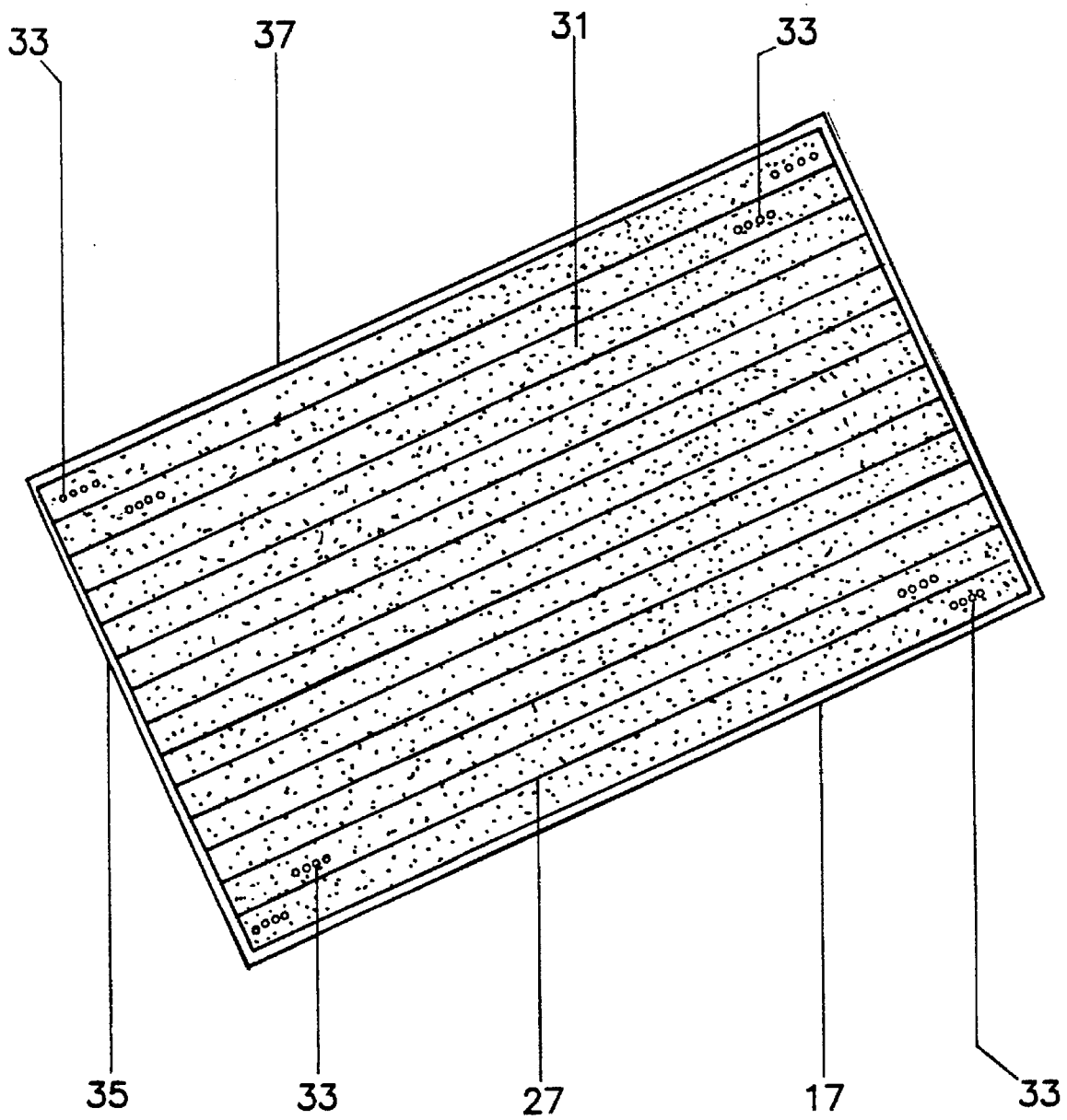
FIG. 3 is a top view of the pad of the invention.
Figure 4:
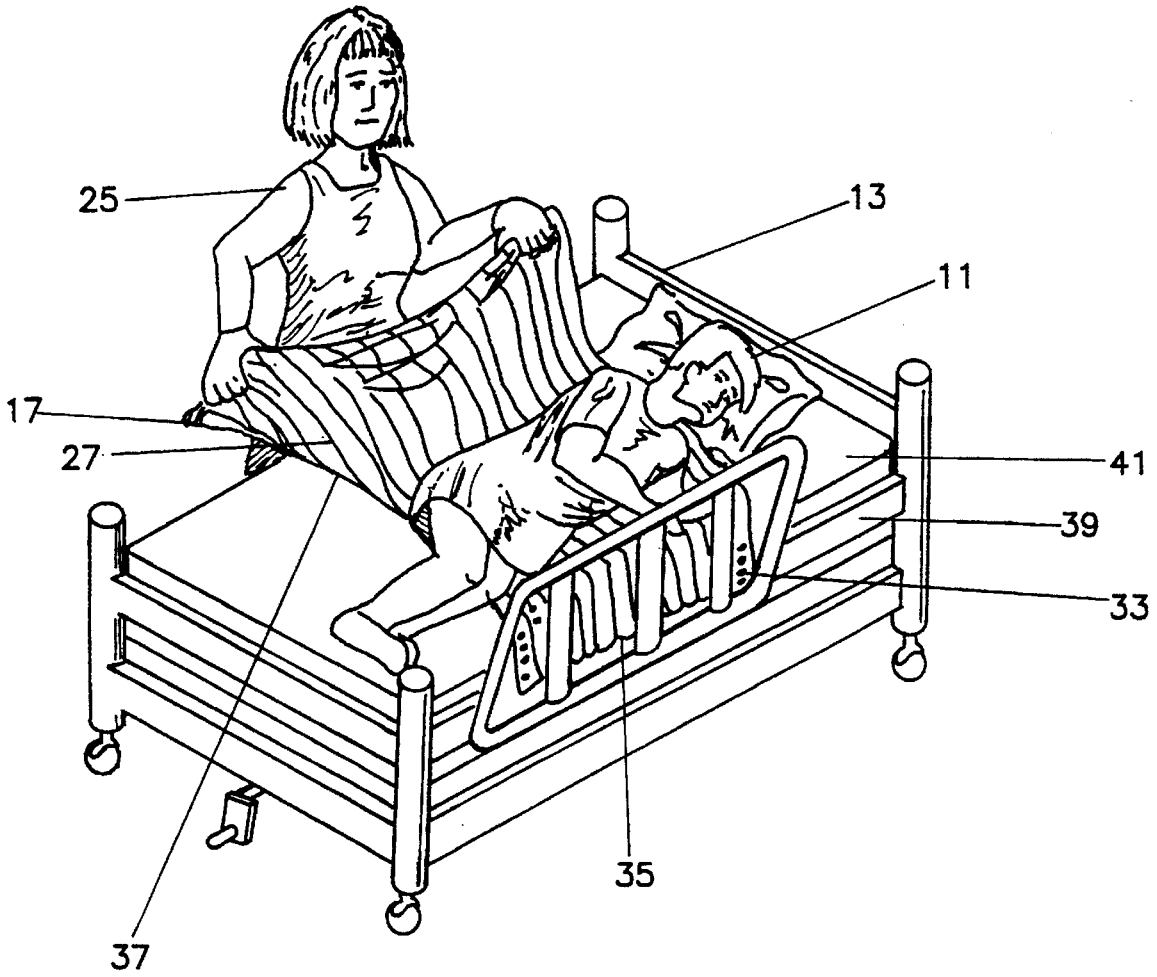
FIG. 4 is a view of a single caregiver turning a human by use of the pad.
Figure 6:
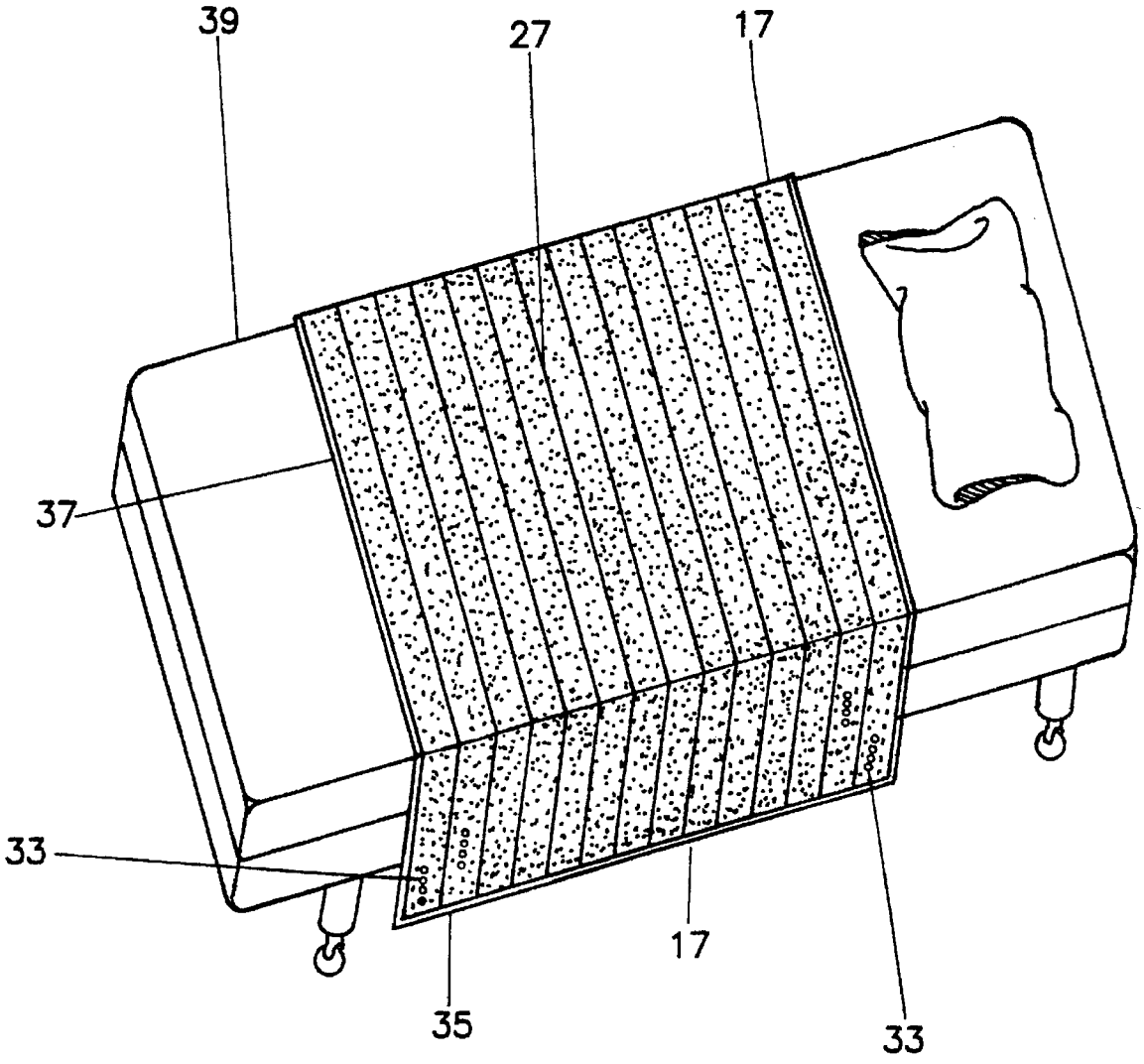
FIG. 6 is a view of the pad of the invention on a mattress.

The pad 17 shown in FIGS. 3 and 6 is generally rectangular in shape. In the preferred embodiment for use in the prevention and treatment of bed sores, the pad 17 has a width of 45 inches and a length of 72 inches. The pad 17 is long enough to extend across the bed 13 and hang from the bed sides so that the ends 35 of the pad 17 can be grasped or the digital eyelets 33 used by health caregivers 25 to turn or move a patient 11 in the bed 13. Also, the long ends 35 allow the ends to be tucked under the mattress 39 to anchor the pad 17 in place on the bed 13 and prevent pad 17 movement. The width of the pad 17 need only be large enough to extend from the shoulders to mid-thigh of a patient 11. The legs need not rest on the pad 17. The short width of the pad 17 makes it easier for caregivers 25 to manipulate the pad 17.

In use, the pad 17 is located between the patient 11 and the bed 13 such that the bottom wall 21 contacts a bed sheet 41. The bed sheet 41 covers the bed mattress 39. The patient 11 lies directly on top of the pad 17. The pad 17 is positioned as shown in FIG. 1, where the ends 35 of the pad 17 extend across the bed 13 to the sides of the bed 13 while the shoulders, back and thighs of the patient 11 rest on the pad 17. The ends 35 of the pad 17 are tucked under the mattress 39 to prevent the pad 17 from moving. The patient 11 may be covered by a top sheet 41 and blanket.

The pad 17 can be used to move the patient 11 on the bed 13. The slick satin bottom wall 21 slides easily on the bed sheet 41. The ends 35 of the pad 17 can be freed from under the mattress 39 and gripped or the digital eyelets 33 used, and the patient 11 can be turned, slid, or otherwise moved on the bed 13. The sliding movement of the patient 11 on the bed 13 is smooth due to the reduced friction between the bottom wall 21 and the bed sheet 41.

The pad 17 may be located beneath the patient 11, even if the patient 11 will not be moved in the immediate future. When the patient 11 is ready to be moved, the pad 17 is already in position, eliminating the need to roll the patient 11 over and onto the pad 17.

Besides easing movement off of the bed 13, the pad 17 reduces the incidence of bed sores. The soft top wall 19 reduces the risk of friction burns. The padding 23 provides cushion under the patient 11 and reduces the pressure on the skin. The padding 23 and the top and bottom walls, 19 and 21, which are all permeable to air, allow air to circulate around the patient's 11 skin. All of these aspects of the pad 17 reduce the risk of bed sores.

In addition, use of the pad 17 beneath a patient 11 will accelerate the healing process of established bed sores for the same reasons that the pad 17 reduces the incidence of bed sores. With the pad 17, patients 11 with bed sores are able to lay on their bed sores. Conversely, patient 11 who do not utilize the pad 17 must lay in positions that avoid laying on the bed sores.

The tricote top wall 19 wicks away moisture and perspiration from the patient 11. Air circulation through the pad 17 allows the moisture to readily evaporate, keeping the pad 17 and the patient 11 dry. This helps to keeps the patient 11 cleaner and the skin healthier because the growth of bacteria is inhibited.

When the pad 17 has become soiled, the pad 17 is washed in hot water and detergent. In some cases, the pad 17 should be washed every day, or even several times a day. The pad 17 may be washed many times without degrading its patient-moving or its bed sores treatment aspects. The pad 17, with its air circulation aspects, dries quickly.

In addition, the pad 17 can be used to move the patient 11 off the bed 13 and onto a waiting gurney 15. The pad 17 makes patient 11 movement fast and easy. The sliding movement of the patient 11 on the bed 13 is smooth due to the reduced friction between the bottom wall 21 and the bed sheet 41. The digital eyelets 33 make it possible for the caregivers 25 to obtain a firm grip on the pad 17, thus reducing the possibility of dropping the patient 11. The foregoing disclosure and the showings made in the drawings are merely illustrative of the principles of this invention and are not to be interpreted in a limiting sense.

DUAL PURPOSE PATIENT PAD METHOD

I claim:

1. A pad for use by a human lying in bed for an extended length of time, comprising:

a) a first wall made of a fabric that is permeable to air, said first wall being adapted to be placed in contact with said bed, said first wall fabric being slick and smooth to permit a caregiver to move or turn said human lying on said bed by sliding the pad between the human and a sheet on the bed such that the sliding is in a smooth manner;

b) a second wall made of a soft, air permeable fabric, said second wall laying substantially parallel to said first wall, said second wall being adapted to be placed in contact with said human, said material being composed of an air permeable material that rapidly dissipates bodily fluids and reduces friction when contact the skin of said human when said human is lying on said pad;

c) a middle layer of padding material being located between said first and second walls, said padding being permeable to air, the padding material to provide sufficient cushioning effect while allowing airflow between the first wall and second wall materials to dissipate bodily fluids away from said human when said human is lying on the pad;

d) said first wall, said second wall and said padding being coupled together, wherein said human can lay on said pad while in bed and said pad will reduce the pressure on said human and allow air circulation through said pad, and said top wall will reduce friction burns on said human so as to reduce the incidence of bedsores, pressure ulcers or skin ulcerations, and the edge area of the pad having at least one set of digital eyelets comprised of spaced holes adapted to accommodate four fingers of a caregiver, whereby at least one caregiver can grasp the pad to move the pad.

2. The pad of claim 1 wherein said first wall is made of satin material.

3. The pad of claim 1 wherein said second wall is made of tricote material.

4. The pad of claim 1 wherein said padding is made of high loft hollowfill batting.

5. The pad of claim 1 wherein said first wall is made of satin material, said second wall is made of tricote material, and said padding is made of high loft hollowfill batting.

6. The pad of claim 1 wherein said second wall has a plurality of small openings to further facilitate circulation of air through the pad.

7. The pad of claim 1 wherein opposed sides of the pad has plural sets of digital eyelets in order for more than one person to grasp the pad.

8. A system comprising:

a) a mattress and a bed sheet on top of said mattress;

b) a pad comprising a first wall, a second wall and a middle layer;

c) said first wall being made of a fabric that is permeable to air, said first wall being in contact with said bed sheet, said first wall fabric being so slick and smooth to permit a caregiver to move or turn a human patient lying on the bed by sliding the pad between the human patient and the sheet such that the sliding is in such a smooth manner as to minimize pain to the human patient;

d) said second wall being made of a soft, air-permeable fabric, said second wall laying substantially parallel to said first wall, said second wall being adapted to be placed in contact with said human;

e) said middle layer of padding and being located between said first and second walls, said padding material begin sufficiently permeable to allow airflow to the skin of said patient and sufficient to rapidly dissipate moisture to such an extent that skin irritation and bacterial growth is reduced;

f) said first wall, said second wall and said middle layer being coupled together;

g) said pad being oriented on said bed so that a human can lay on said second wall when said human lays on said bed;

h) the edge of the pad having at least one set of digital eyelets comprised of spaced holes adapted to accommodate four fingers of a caregiver, whereby at least one caregiver on grasp the pad to move the pad.

9. The system of claim 8 wherein said pad has ends that are tucked under the mattress to prevent said pad from moving relative to the bed.

10. The system of claim 8 wherein said first wall is made of a satin material.

11. The system of claim 8 wherein said second wall is made tricote material.

12. The system of claim 8 wherein said padding is made of high loft polyester batting.

13. The system of claim 8 wherein said first wall is made of satin material and second wall is made of tricote material and said padding is made of high loft hollowfill polyester batting.

14. The system of claim 8 wherein the pad has plural sets of digital eyelets for more than one person to grasp the pad.

15. A method of moving a human on a bed, comprising the steps of;

a) prepositioning a pad beneath said human lying on said bed, said pad comprising;

i) a first wall made of a fabric that is permeable to air, said first wall being placed in contact with a sheet on said bed, said first wall fabric being so slick and smooth to permit a caregiver move or turn said human lying on said sheet;

ii) a second wall made of a soft, air permeable fabric, said second wall laying substantially parallel to said first wall, said second wall placed in contact with said human;

iii) a middle layer of padding material being located between first and second walls and said padding being permeable to allow air flow to the skin of said human, said padding material being composed of an air permeable material that rapidly dissipates bodily fluids and reduces friction when contacting the skin of said human lying on said pad;

iv) said first wall, said second wall and said padding being coupled together, wherein said top wall aids in reducing friction burns and the incidence of bed sores, pressure ulcer, or skin ulceration when using the pad to move or turn said human, the edge area of the pad having at least one set of digital eyelets comprised of spaced holes adapted to accommodate four fingers of a caregiver, whereby at least one caregiver can grasp the pad to move the pad;

b) allowing said human to lay on said pad for an extended length of time, wherein said pad reduces the incidence of bed sores on said human;

c) when the need of moving or turning said human on said bed arises, sliding said pad with said human thereon on said bed to a desired position, wherein said bottom surface reduces the friction between said human and said bed and eases the effort required to move said human;

d) the step of moving or turning said human being accomplished by a caregiver grasping digital eyelets of the pad and moving said pad while grasping said digital eyelets.

* * * * *